United States Patent [19]

Ishida et al.

[11] Patent Number: 4,837,979

[45] Date of Patent: Jun. 13, 1989

[54] POLISHING DEVICE

[75] Inventors: Takao Ishida, Aichi; Hiroshi Hagiwara; Ichizo Kakumu, both of Nagoya, all of Japan

[73] Assignee: Sintobrator, Ltd., Nagoya, Japan

[21] Appl. No.: 168,819

[22] Filed: Mar. 16, 1988

[30] Foreign Application Priority Data

Mar. 17, 1987 [JP] Japan ..... 62-62109
Mar. 17, 1987 [JP] Japan ..... 62-62110
Mar. 27, 1987 [JP] Japan ..... 62-75638

[51] Int. Cl.[4] ..... B24B 7/16
[52] U.S. Cl. ..... 51/131.4; 51/215 CP
[58] Field of Search ..... 51/118, 123 R, 124 R, 51/124 L, 131.3, 131.4, 131.5, 132, 232, 234, 115, 215 R, 215 AR, 215 CP, 215 UL, 165.77, 165.8

[56] References Cited

U.S. PATENT DOCUMENTS 2,912,798 11/1959 Seidel ..... 51/215 UE
3,904,390 9/1975 Bottomby ..... 51/165.8
3,968,598 7/1976 Ogawa ..... 51/55
4,141,180 2/1979 Gill, Jr. ..... 51/124 R
4,680,893 7/1987 Cronkhite ..... 51/131.3

FOREIGN PATENT DOCUMENTS 0063625 4/1981 European Pat. Off. .
1222400 8/1966 Fed. Rep. of Germany .
2346431 3/1974 Fed. Rep. of Germany .
3339942 1/1985 Fed. Rep. of Germany .
236044 5/1986 Fed. Rep. of Germany .
1585540 1/1970 France .
0227361 12/1984 Japan ..... 51/131.3

OTHER PUBLICATIONS

Sovient Inventions Illustrated, Section Mechanical, Week 84/01 Abstract No. 004494 P61, 5th Feb., 1984, Derwent Publications, Ltd., London.

*Primary Examiner*—Frederick R. Schmidt
*Assistant Examiner*—Blynn Shideler
*Attorney, Agent, or Firm*—Armstrong, Nikaido, Marmelstein, Kubovcik & Murray

[57] ABSTRACT

The upper portion of a frame of a lapping device is provided with a device for supplying a workpiece, a grindstone, and a delivering device, and a movable arm is horizontally and movably supported by a support column of the frame in such a manner that the arm moves above the supplying device, grindstone, and the delivering device. The movable arm is provided with an device for autorotating the workpiece, the autorotating device being able to move upwardly or downwardly through the pressurizing device, and the movable arm further being provided with a device for holding the workpiece beneath the autorotating device. The workpiece is transported by the holding device to a position above the grindstone, and is brought into abutment with the grindstone by a holding member which is disposed at the lower end of the autorotating device, whereby it is ground with being rotated.

2 Claims, 3 Drawing Sheets

POLISHING DEVICE

BACKGROUND OF THE INVENTION (1) Field of the Invention

This invention relates to a device for polishing flat surfaces of metallic parts or ceramic substrates and so forth.

(2) Description of the Prior Art

In order to polish flat surfaces of metallic parts and so forth, a lapping method is generally used in which "corundum" or "Carborundum" works as free abrasive grains, another generally-used lapping method is one in which the above-described abrasive grains are fixed by way of embedding or the like, and a still further method is generally employed in which a surface abrasive disc is used.

However, in a lapping method in which the free abrasive grains are used, a multiplicity of workpieces are treated for a long time in a batch manner. Therefore, an in-line working method in which only one workpiece is individually polished successively cannot be employed. As a result of this, it is difficult to treat the workpiece in a short-time with dimensional accuracy and with consistent finishing performance. In this method, with a multiplicity of working pieces held between the lapping discs by means of a holder, they are simultaneously polished in a batch manner for a long time. Therefore, a great stock during machining or partially fabricated items between manufacturing processes need to be kept, thereby the inventory increases. Furthermore, since a great quantity of fine-abrasive grains is used, running costs become high, and dust is generated causing the work environment to deteriorate. As a result of this, it is difficult to establish a line system in which precision instruments are synchronized with the polishing device. Furthermore, the lapping discs becomes eccentrically worn, and modification of the same become complicated, thereby it takes a long time, as a result of which, an operation rate decreases, causing the running cost to. Furthermore, since the lapping fluid used for machining is difficult to be stored, it needs to be adjusted at short intervals. Furthermore, in this method, manufacturing capacity is too small, and two or more processes such as a rough lapping process and a fine lapping process need to be conducted, therefore, the whole body of the machining device becomes large and expensive. On the other hand, the stationary-abrasive grains lapping method has no significant difference from the above-described method because this method merely employs a lapping disc which contains abrasive grains in place of the lapping disc used in the former method. The abrasive grains fixed by embedding or the like can be easily worn, and a great degree of loading of them occurs. Furthermore, if a thin filmy grindstone like a sandpaper is used, it wears out in a short period of time, therefore, it must be frequently changes. As a result of this, running costs increase significantly, the modification of the filmy grindstone is very difficult, and the manufacture capacity is not significantly different from that conducted by the free abrasive grains. In a method in which a flat grinding disc is used, since both the workpiece and the grindstone are strongly secured, the accuracy of the machine corresponds to the accuracy of the finished surface of the workpiece. Therefore, the cost of the machine becomes high. Furthermore, the roughness of the finished surface which can be achieved by the lapping method is difficult to be achieved in this method. In a grinding method in which a disc-type grindstone is used, if a machining allowance is made large for the purpose of grinding a workpiece in a short time, the grindstone is excessively worn, and good accuracy of the finished surface is not obtained.

Meanwhile, a known method of supporting the workpiece metallic parts or the like is such as a method in which a workpiece is brought into abutment under a certain proper pressure against the top surface of the grindstone which is being rotated horizontally by means of a holding plate secured to the lower end of a vertically-movable shaft. Another method is known in which a grindstone is secured to the lower end of the vertically-movable shaft, while a workpiece is located on a table beneath the grindstone. The workpiece is ground by rotating and lowering the vertically-movable shaft.

However, in such methods, if accurate parallelism is not achieved between the holding plate at the lower end of the vertically-movable shaft and the grindstone disposed beneath the holding plate, or between the grindstone at the lower end of the vertically-movable shaft and the table disposed beneath the grindstone, chatters of the workpiece occur during grinding, and offset wear is generated, thereby an accurate flat plane cannot be obtained, and the roughness deteriorates. As a result of this, stable dimensional accuracy cannot be obtained. Furthermore, the grindstone and the table also create offset abrasion which is very difficult and takes a long time to correct. These problems become further significant if the machining tolerance is enlarged and high pressures are applied to both the grindstone and workpice for the purpose of conducting a short-time machining. In a case where the workpiece is a special shape having a certain roughness on the reverse side thereof which is the other side to the machined side, a proper elastic pad is interposed between this reverse side and the holding plate or the table for the purpose of preventing slippage the workpiece during machining. However, it cannot assuredly prevent the slippage, therefore, it cannot be used for the high pressure machining.

Meanwhile, in order to control the grinding work, a machining condition such as the rotational speed of a grindstone and workpiece or the pressure applied is changed.

However, in order to change the above-described machining conditions during grinding work, a large sized device is needed, also causing costs to rise. Furthermore, good surface roughness in proportion to the costs cannot be obtained, and the most suitable quality range of the grindstone is too narrow, and is impossible to be changed. Especially, the change of the applied-pressure is an important factor in the grinding work, for example, if the applied pressure is high, a grinding force becomes large, causing the time period required to complete the grinding to become short, however the roughness of the finished surface is not sufficient, and chatter of the workpiece will be generated during machining work, deteriorating the grade of the finished surface. On the other hand, if the applied-pressure is low, the grinding force becomes small, and, a fine finished surface can be obtained. That is, by way of including the setting and control of the machining pressure in the grinding work, good surface roughness can be efficiently obtained in a short time. Such change of machining pressure is partially employed by a duplex head flat milling machine in which a predetermined load is first applied by means of an air pressure or the same is applied directly by means of a hydraulic pressure cylinder. In this method, it is difficult to optionally set and control the machining pressure during machining, furthermore, the machining pressure per unit area of a workpiece cannot be increased.

SUMMARY OF THE INVENTION

A polishing machine according to the present invention is constituted by a device for supplying a workpiece, a grindstone, and a device for delivering the same, which are disposed on a frame, a movable arm which is disposed above the grindstone so as to move horizontally in such a manner that the movable arm passes above each workpiece-supplying device, grindstone and the workpiece-delivering device, the movable arm having a workpiece-autorating device which is capable of moving vertically through a pressurizing device and a workpiece-holding device which is disposed in the lower portion of the autorotating device.

A method of polishing according to the present invention is constituted by: a step in which the workpiece is brought into close contact with a surface of a rotating grindstone, a step in which while the working pressure applied to the workpiece is successively raised until it reaches a predetermined pressure, the workpiece is ground until it reaches the predetermined pressure, and is continuously ground under the pressure for a predetermined time period, and a step in which the workpiece is ground with the applied pressure being reduced.

An object of the present invention is to provide a polishing device due to the above described constitution in which workpieces are successively transported from the supplying device via the grindstone to the delivering device in an individual treatment method in place of a batch method. In the polishing device, the workpiece is brought into abutment through a pressurizing device with a grindstone of a stationary abrasive grain type with its grinding surface facing upwardly, and the workpiece is autorotated and moved, and the pressure applied is changed so that the polishing ability is improved.

Another object of the present invention is to provide a polishing device in which a workpiece is at all times positioned in close contact with a surface of a grindstone in such a manner that the workpiece is positioned along the surface of the grindstone.

A still further object of the present invention is to provide a method of polishing in which control of the applied-pressure is properly conducted during polishing work so that a highly accurate finished surface can be efficiently obtained.

DESCRIPTION OF THE PREFERRED EMBODIMENTS

Figure 1:
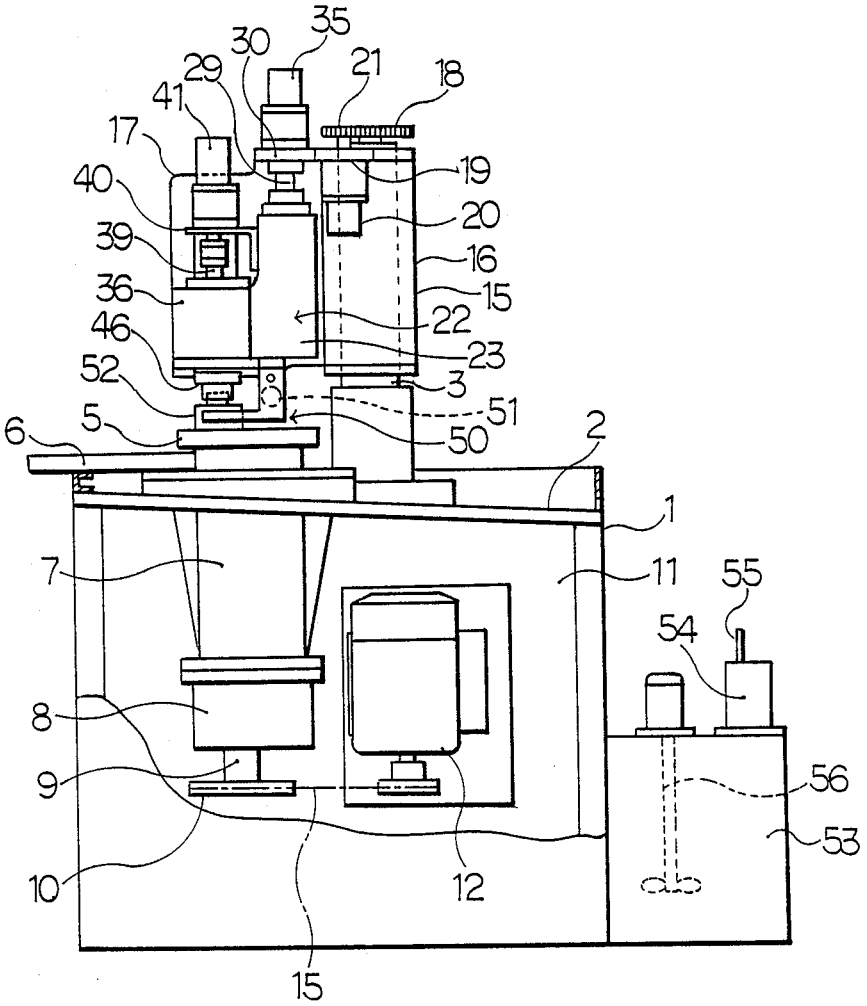
FIG. 1 is a front elevational view, from which a part is omitted, of a polishing device according to an embodiment of the present invention.
Figure 2:
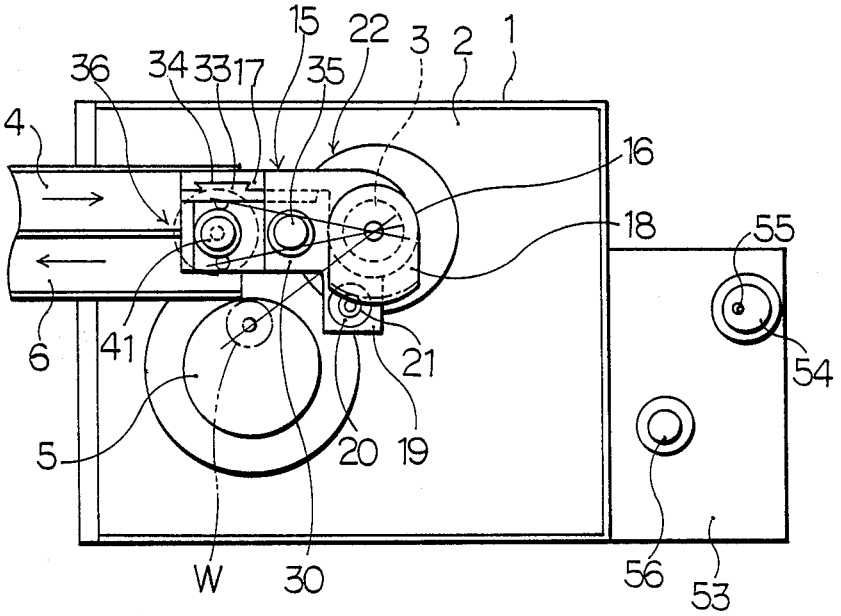
FIG. 2 is a plan view of the above-described device.
Figure 3:
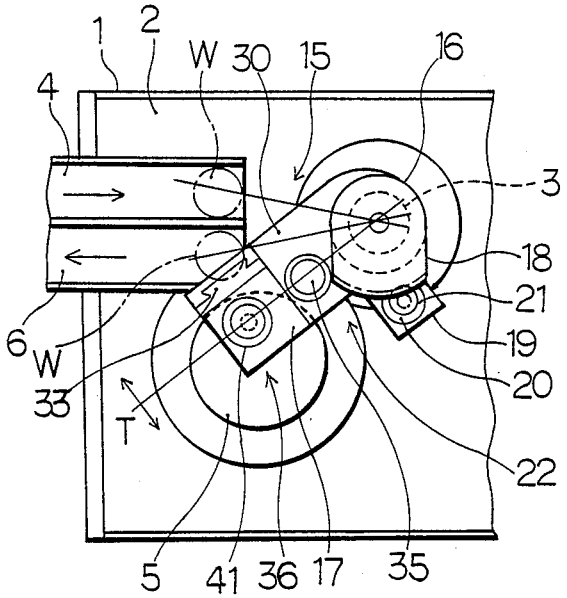
FIG. 3 is a plan view illustrating a state where a movable arm is moved.
Figure 4:
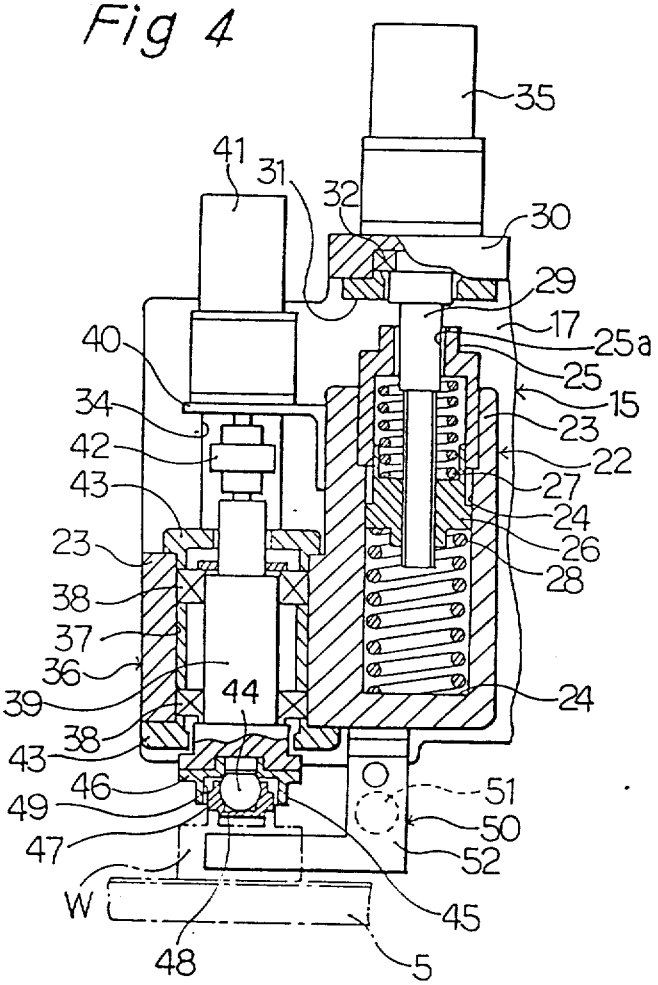
FIG. 4 is a front elevational view, from which a part is omitted, of a pressurizing device and an autorotating device.

Referring to the accompanying drawings, an embodiment of the present invention will be described in detail. Referring to FIGS. 1 and 2, a box-shaped frame 1 has a slanted top surface plate 2 and a vertical support column 3. As shown in FIG. 2, around the support column 3, a workpiece-supplying device 4, a grindstone 5, and a delivering device 6 are disposed. The supplying device 4 and the delivering device 6 are each a vibration-type conveyor or a chute for carring out transportation, the supplying device 4 and the delivering device 6 being disposed on the top surface plate 2. The grindstone 5 is of a rotational disc type formed by a metal-bond grindstone or the like, and is journaled by a bearing 7 held by the top surface plate 2 with the grinding surface thereof faced upwardly in such a manner that the grindstone 5 can rotate horizontally. The lower end of a vertical shaft (omitted from illustration) of the grindstone 5 is connected to a vertical drive shaft 9 in a gearbox 8 which is connected to the lower portion of the bearing 7. A V-pulley 10 is secured to the drive shaft 9, and is connected to a V-pulley 13 by way of a V-belt 14. Grindstone 5 is rotated by a motor 12, connected to a side wall 11 of the frame 1, driving said pulleys and the gearbox 8. A cylindrical base 16 of a movable arm 15 is rotatably held by the support column 3 by a bearing (omitted from illustration). A vertical plate-shaped arm portion 17 which is continuous from the base 16 is so constituted that it rotates horizontally relative to the support column 3 in such a manner that it successively positioned above the supplying device 4, grindstone 5 and the delivering device 6. As shown in FIG. 2, this rotation is realized by a rotary mechanism in which a sector gear 18 and a pinion 21 of a motor 20 are engaged with each other, the motor 20 being fitted to a base 19 which is horizontally extended from the top end of the base 16 of the movable arm 15. That is, when the pinion 21 is rotated by the actuation of the motor 20, the pinion 21 is rotated along the contour of the sector gear 18 because the pinion 21 is engaged with the sector gear 18 which is secured to the support rod 3. As a result of this, the movable arm 15 is horizontally rotated relative to the support column 3 through the base 19 and the motor 20, and thus the arm portion 17 of the movable arm 15 is successively positioned above the supplying device 4, grindstone 5, and the delivering device 6. The rotary mechanism is constituted in such a manner that, especially when the arm portion 17 is, as shown in FIG. 3, positioned above the grindstone 5, the arm portion 17 is horizontally moved above the grindstone 5 by way of setting a control circuit of the motor 20 for the purpose of making the motor rotate forwardly or rearwardly for a predetermined number of revolutions. A pressurizing device 22 is a device provided for raising and lowering an autorotating device to be described hereinafter for the purpose of applying a workpiece to the grindstone 5 with a proper pressure, and is, as shown in FIG. 4, provided for the movable arm 15. A casing 23 of the pressurizing device 22 has a vertical pressurizing hole portion 24 therein and a cover 25 at the top opening thereof, the cover 25 having a through hole 25*a* at the central portion thereof. A raising and lowering body 26, having at the central portion thereof a ball-threaded portion, is inserted into the intermediate portion of the pressurizing hole portion 24 in such a manner that the raising and the lowering body 26 can move vertically.

The raising and lowering body 26 is arranged not to be rotated in the pressurizing hole portion 24 by means of a stopper mechanism (omitted from illustration) which is disposed between the movable portion of the raising and lowering body 26 and the pressurizing hole portion 24. The upper portion of the pressurizing hole portion 24, the upper portion being defined by the raising and lowering body 26, accommodates a coil spring 27 for balancing the weights of the casing 23 which includes the autorotating device for the workpiece, cover 25, and the raising and lowering body 26. On the other hand, the lower portion of the pressurizing hole portion 24 accommodates a coil spring 28 which serves to apply pressure to grind the workpiece. A vertical shaft 29 (screw shaft) having a ball-threaded portion on the outer surface thereof is inserted into and engaged with the ball-threaded portion of the raising and lowering body 26 which is disposed between the coil springs 27 and 28. The upper portion of the vertical shaft 29 is rotatably hung from a hole portion in a base 30 which is horizontally projected from the arm 17 through a bearing 32 which is held by a cover 31. Namely, the casing 23 and so forth including the autorotating device are hung from the base 30, that is the movable arm 15 by means of an elastic force of the coil spring 27 on the raising and lowering body 26 which is engaged in a threaded manner with the vertical shaft 29. On the surface of casing 23, the surface confronting the arm portion 17, a movable securing portion 33 is, as shown in FIG. 2, projectingly provided, while on the surface of the arm portion 17, the surface confronting the movable securing portion 33, is formed in a vertical direction a guide groove 34 which corresponds to the movable securing portion 33. As a result of this structure the casing 23 can be raised and lowered vertically along the arm portion 17. The top end of the vertical shaft 29 is connected to a drive shaft of the motor 35 through a joint (omitted from illustration), the motor being fitted to the base 30. The raising and lowering body 26 is raised or lowered along the vertical shaft 29 by the forward or the reverse rotation of the motor 35. When the raising and lowering body 26 is lowered, the lower coil spring 28 is pressurized. This applied pressure is conducted to the casing 23, thereby the casing 23 is lowered by way of being guided by the guide groove 34. On the other hand, when raising and lowering body 26 is raised, the pressure which is applied to the coil spring 28 is decreased, and simultaneously the upper coil spring 27 is pressurized. This applied pressure is conducted to the casing 23 through the cover 25. Then, when the resilience force of the coil spring 27, the same of the coil spring 28 and the dead weight of the casing 23 and so forth are balanced, the casing 23 is stopped and is suspended in a steady position from the vertical shaft 29. The autorotating device 36 is a device for autorotating the workpiece held by the casing 23 at the side portion of the pressurizing device 22. The autorotating device 36 is capable of raising and lowering through the pressurizing device 22. The autorotating device 36 has an autorotating shaft 39 which is journalled by a pair of bearings 38 in an autorotating hole 37 thereof, the autorotating hole 37 being formed in parallel with the pressuring hole portion 24 in the casing 23. The top end of the autorotating shaft 39 is connected to a drive shaft of the motor 41 which is fitted to a bracket 40 projected from the casing 23. Covers 43 are respectively fitted to the top end and lower end of the autorotating shaft 39. A protector 46 having a cylindrical surface 45 is secured to the lower end of the autorotating shaft 39 by means of a bolt or the like in such a manner that the protector 46 is disposed concentrically to the autorotating shaft 39. The shaft portion of a spherical body 44 is inserted into and secured to the central hole in the protector, as a result of which the lower end of the autorotating shaft 39 is provided with the spherical body 44. A housing 47 is positioned in the area surround by the cylindrical surface 45 in such a manner that a hole portion in the upper portion of the housing 47 is rotatably fitted in and held by the spherical surface of the spherical body 44 in such a manner that the hole portion can be slanted with respect to the spherical surface of the spherical body 44. A securing portion 48 which is provided for securing the workpiece is provided in the lower portion of the housing 47. That is, a mechanism for holding a workpiece having a ball joint structure is formed at the lower end of the autorotating shaft 39, the mechanism comprising the spherical body 44 and the housing 47 which is movably fitted to the former. As a result of this, when the upper surface of the workpiece on the grindstone 5 is secured to the securing portion 48, and the autorotating shaft 39 with the casing 23 is lowered by the pressurizing device 22, the workpiece is uniformly pressurized through the housing 47 which is movably fitted to and held by the spherical body 44 with rotating the autorotating shaft 39 by means of the motor 41. As a result of this, the workpiece is brought into close contact with the upper surface of the grindstone 5. A dust-proof seal ring 49 is disposed between the protector 46 and the housing 47.

A holding device 50 is held by the lower portion of the movable arm 15 in such a manner that the workpiece is held at the position beneath the autorotating device 36. The holding device 50 is formed by a pair of holding arms 52 which are closed and opened by a hydraulic pressure cylinder 51. A cooling-fluid chamber 53 is disposed at the side position of the frame 1, and the cooling fluid in the chamber 53 is introduced into the grinding portion having the grindstone 5 through the cooling-fluid pipe 55 by a pump 54. The cooling fluid is arranged to return to the chamber 53 by means of the slanted top surface 2, and a stirrer 56 is provided in the chamber 53.

The operation will be described below. The motor 12 is driven so as to rotate the drive shaft 9 through the V-pulley 13, V-belt 14, and the V-pulley 10. Then, the shaft of the grindstone, that is grindstone 5, is rotated at substantially 50 to 500 m/min through the gearbox 8. Simultaneously the pump 54 is driven to supply and circulate the cooling fluid between the grinding portion through the cooling-fluid pipe 55, and the movable arm 15 is positioned above the supplying device 4. Then, the workpiece W is supplied to a predetermined position by the supplying device 4, and the motor 35 of the pressurizing device 22 is actuated to rotate the vertical shaft 29 for the purpose of downwardly moving the raising and lowering body 26. As a result of this, the coil spring 28 in the lower portion of the pressurizing hole portion 24 is pressurized, and the casing 23 is lowered due to the elastic force of the former. The hydraulic cylinder 51 of the holding device 50 is actuated at the lower end of the downward movement o f the casing 23. As a result of this, the workpiece W is held between the holding arms 52. Then, the raising and lowering body 26 is raised by reverse rotation of the vertical shaft 29 by means of the motor 35, and the pressure applied other coil spring 28 is thereby released. As a result of this, the casing 23 with the holding device 50 which holds the workpiece W is returned to the original position. Then the motor 20 is actuated, and the movable arm 15 is horizontally rotated relative to the support column 3 by means of the engagement achieved by the sector gear 18 and the pinion 21. The movable arm 15 is, as shown in FIG. 3, positioned above the grindstone 5, and the motor 35 is again actuated so that the casing 23 is, similarly to the description above, lowered to the predetermined position. At the end of the downward movement of the casing 23, the hydraulic cylinder 51 is actuated inversely, and the holding arms 52 are opened, whereby the workpiece W is released and positioned on the grindstone 5. Simultaneously, the motor 35 is further slightly rotated, and the casing 23 and the autorotating shaft 39 are slightly moved downwardly through the vertical shaft 29, raising and lowering body 26, and the coil spring 28. As a result of this, the workpiece W is brought into uniformly abutment against the top surface of the grindstone 5 through the spherical body 44 at the top end of the autorotating shaft 39 and the housing 47.

In this state, since the housing 47 is arranged to be movable with respect to the spherical surface of the spherical body 44, the housing 47 can follow the slanted surface and so forth of the securing portion and thereby can incline or rotate relative to the spherical body 44 even if the parallelism is not obtained between the securing portion 48 and the aforementioned securing portion. As a result of the modifying action of the housing 47, two parts are properly secured to each other, whereby the machined surface of the workpiece W is brought into uniformly close contact with the top surface of the grindstone 5, and a uniform pressure can be applied to the workpiece W.

Simultaneously, the motor 20 rotates forwardly and rearwardly for a predetermined number of revolutions so that the arm 15 is moved as shown by an arrow T shown in FIG. 3, and the motor 41 is actuated so that the autorotating shaft 39 is rotated. As a result of this, the workpiece W is uniformly pressurized onto the grindstone 5 by means of the autorotating shaft 39, and is autorotated and moved, as a result of which it is uniformly ground. As a result of the downward movement of the casing 23 of the pressurizing device 22 by means of the motor 35, that is the downward movement of the autorotating shaft 39, the pressure which is applied to the workpiece W is successively raised starting from a low pressure until it reaches a predetermined high pressure for machining. Then, the motor 35 is stopped, and the downward movement of the autorotating shaft 39 is thereby stopped. As a result of this, the workpiece W is continuously ground under a predetermined high pressure. After the grinding work under the predetermined pressure has been conducted for a predetermined time period, the motor 35 is reversely rotated so that the casing 23 and autorotating shaft 39 are raised through the vertical shaft 29, the raising and lowering body 26 and the coil spring 28. As a result of this, the pressure applied by the workpiece W to the grindstone 5 is reduced until a predetermined low level is reached and motor 35 is stopped. The grinding work is continued for a predetermined time period at the low level. The above-described grinding work is successively conducted with the pressure being reduced until the grinding work is completed. When the grinding work is completed, the motor 41 is stopped so that the rotation of the autorotating shaft 39 is stopped, and simultaneously the hydraulic pressure cylinder 51 is actuated so that the workpiece W is grasped by the holding arms 52. Then the motor 20 is stopped so that the movement of the arm 15 is stopped, and simultaneously the vertical shaft 29 is reversely rotated by the motor 35 so that the casing 23 and the workpiece W, which has been ground, are raised until they reach the top end of the upward movement at which the motor 20 is reversely rotated. As a result of this, in the inverse direction to that in the above description, the pinion 21 is rotated along the sector gear 18, and the arm 15 is horizontally rotated toward the delivering device 6 relative to the support column 3. When the workpiece W reaches the delivering device 6, the motor 20 is stopped and the other motor 35 is rotated. As a result of this, the workpiece W held by the holding device 50 is moved with the casing 23 downwardly until its lower end of the range of movement at which the workpiece W is positioned immediately above the delivering device 6. At this position, the holding arms 52 are opened by means of the hydraulic pressure cylinder 51, whereby the workpiece W is released and moved on the delivering device 6. Then, the casing 23 is raised by reverse rotation of the vertical shaft 29 by means of the motor 35. After the casing 23 has been raised, the motor 20 is actuated so that the arm 15 is horizontally rotated, similar to the above description, so that the arm 15 is returned to the position above the supplying device 4. During these processes, the workpiece W which has been ground is moved to a predetermined position by the operation of the delivering device 6.

Figure 5:
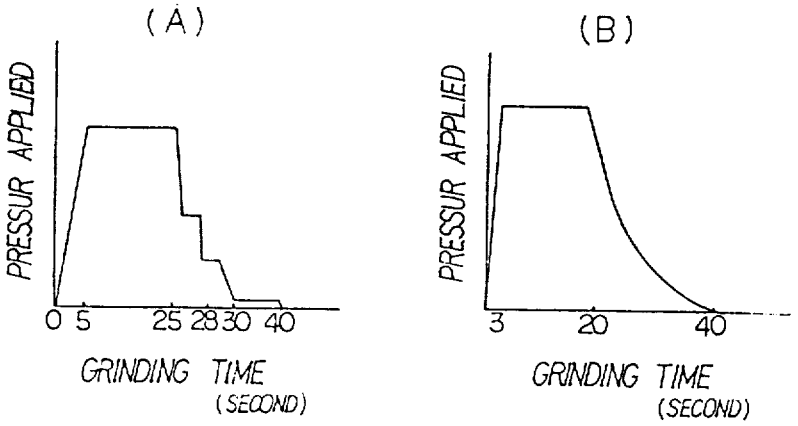
FIGS. 5(A) and 5(B) are graphs showing change of the applied pressured.

Then the above processes are repeated, and workpieces W which are successively introduced to the supplying device 4 are successively ground. FIGS. 5 (A) and 5 (B) illustrate an example of a method of controlling the manufacturing pressure used in the above grinding work. FIG. 5 (A) illustrates an example in which a predetermined working time is set at 40 seconds, it takes five seconds to reach the maximum manufacturing pressure without any interruption, and the workpiece is ground at this manufacturing pressure for 20 seconds, then with manufacturing pressure reduced in a stepped manner, the workpiece is ground under a reduced pressure. In a case where a workpiece made of cast iron is ground, the amount of removal was 50 μm/40 sec, and the roughness of the finished surface was 0.4 to 0.5 μm Rz. FIG. 5 (B) illustrates an example in which it takes three second to reach the maximum pressure without any interruption, and the workpiece is ground at this manufacturing pressure for 17 seconds, then with the manufacturing pressure reduced without any interruption, the workpiece is ground under a reduced pressure. In a case where the workpiece made of the similar cast iron, the amount of removal was 60 μm/40 sec, and the roughness of the finished surface was 0.5 to 0.7 μm Rz. In a conventional device in which free abrasive grains are used, the manufacturing pressure is 50 to 500 g/cm$^2$. As a result of this, even if a similar workpiece is ground for 15 minutes, only a small amount of removal, 30 μm/15 minutes is obtained, and the roughness of the finished surface is 1.2 to 1.5 μm Rz which is substantially rougher wirh respect to the result of the system according to the present invention, described above.

In this embodiment, although the system is employed in which a high pressure is obtained without any interruption when the pressure is raised, the pressure may be raised in a stepped manner.

As described above, in the initial stage of the grinding work, starting from the primary machined state, the workpiece is brought into contact with the surface of the grindstone so that the workpiece is stably ground without any slippage of the workpiece. Then, a high pressure state is realized for the purpose of improving grinding force and effectively grinding the workpiece in a short time. Then, with the applied pressure reduced successively, the workpiece is ground. As a result of this, a fine roughness of the finished surface and the dimensional accuracy can be improved. Furthermore, since the pressure control during the grinding work can be optionally conducted, a variety of ranges of roughness from a relatively rough finished surface to a mirror surface can be accurately and effectively obtained in a short time with a one pass process in order to correspond to the material and purpose of the products. As a result of this, omissions of the manufacturing process can be realized, thereby a production line can be simplified. Furthermore, the workpiece is ground in an individual grinding manner, the maximum pressure applied for grinding per unit area becomes 500 to 5000 g/cm$^2$ which is significantly higher than that in the other method. Especially in some conditions of the workpiece, it can be arranged up to substantially 10,000 g/cm$^2$, as a result of which, a great grinding force can be obtained. Furthermore, since the machining conditions can be easily set, the grinding procedure can be aligned to process lines machining speeds of the previous and subsequent to the grinding device. Therefore, an automated in-line machining line including the grinding device can be realized. Furthermore, a structure is employed in which a raising and lowering body is lowered by means of the threaded shaft, and the automating shaft is lowered through an elastic member, whereby the workpiece is brought into close contact with the grindstone. Therefore, the working pressure can be easily controlled, and precise grinding conditions can be easily selected for the purpose of corresponding to the variety of forms of workpieces. Furthermore, any excessive load is not applied to the workpiece and the grindstones.

Furthermore, in this embodiment, a grindstone of a rotational disc type of metalbond grindstone is in main used as an alternative to the grinding method in which free abrasive grains are used. Therefore, no dust is generated, and a good work environment is thereby obtained. Therefore, the grinding device can be disposed in a precision machine line. Furthermore, since the rotational speed of the grindstone is relatively low with respect to that of the grindstone used in the conventional grinding works, the vibration can be restricted and the amount of the coolant splashed can be reduced, as a result of which the system has an advantage in the viewpoint of safety. Furthermore, since the grindstone can be prevented from being worn, and its flatness can be kept for a long time, the running cost can be kept low, and the quality of the grindstone can be retained. Furthermore, a certain dressing effect can be obtained. Furthermore, a structure is employed in which the workpiece by autostation and movement is brought into close contact with the upper surface of the grindstone which is being rotated by means of the vertical shaft, and in which the adjustment of the working pressure can be arranged during machining. As a result of this, the grindstone is worn uniformly and the directions of the grinding marks on the workpiece are remained in the unspecific directions. The roughness of the finished surface can be uniformed, thereby a good flatness can be obtained, and a working time can be shortened.

Furthermore, since the grinding can be conducted in a short time, an individual grinding method can be employed, and the stock of the comencement can be kept low. Furthermore, attachment and detachment of the workpiece, machining, and delivery can be automated, and individual treatment of the workpiece can be conducted, causing a special formed workpiece to be able to be treated. Furthermore, in the grinding device according to the present invention, a holding mechanism is provided, which mechanism having a ball joint structure comprising a spherical body provided at the lower end of the autorotating shaft and a housing which is movably fitted to the former. The workpiece is brought into abutment against the upper surface of the grind stone through the holding mechanism. Thanks to the structure designed described above, the workpiece is at all time brought into close contact with the upper surface of the grindstone, therefore, the grinding can be smoothly conducted. As a result of this, not only in a case of a low pressure grinding but also in a case of very high working pressure grinding, the workpiece can be prevented from chattering, generation of any excessive rotation can be prevented, and offset wear generated in the workpiece can be prevented. Therefore, an accurate flat surface can be obtained. Furthermore, a uniform pressure can be applied to the surface between the workpiece and the grindstone, whereby the grinding force can be improved and the grinding performance per unit time period can be improved, as a result of which, working time can be significantly reduced. Furthermore, in a case where the workpiece is autorotated and moved is conducted when the grindstone is rotated, the workpiece is held through a holding mechanism formed by a ball joint structure, the above rotation, autorotation, and movement being capable of easily following the ball joint structure. Therefore, the flatness and roughness of the finished surface of the workpiece can be significantly improved, and any offset wear of the grindstone can be prevented, causing the uniform wear, and wear itself can be reduced. Furthermore, the rotation of the autorotating shaft is applied as a rotational force as an abutting resistance to a holding mechanism formed by the ball joint structure. Thus applied abutting resistance and the rotation of the grindstone make the workpiece in a free state rotate smoothly so as to be ground. Some forms of the workpiece cause an excessive contacting resistance to be generated between the workpiece and the surface of the grindstone. Even if there is factors which cause such a matter, such a excessive rotational force can be absorbed because the workpiece is able to freely rotate in any direction, and the workpiece can rotate in synchronization with the rotation of the grindstone. As a result of this, the workpiece can be smoothly rotated and is thereby ground, causing highly accurate grinding work to be conducted. Furthermore, a workpiece of a special form which has been considered to be a complex can be ground under a high pressure without any necessity of using an elastic pad, and wide variety of such special workpieces can be treated. Furthermore, since the workpiece is brought into abutment against the grindstone through a holding mechanism of a ball joint type, a uniform contact between two parts can be achieved, therefore, a small sized grindstone can generate a good grinding effect, and the grindstone can be used to its final life stage. As a result of this, in a case where an expensive grindstone such as diamond abrasive grain or CBN abrasive grain is used, initial costs can be kept low, and thereby the running cost can be also kept low. Since the workpiece is brought into abutment against the upper surface of the grindstone by the above-described holding mechanism, only relatively low grades of perpendicularity of the autorotating shaft, the degree of parallelization of the same with respect to the grindstone, and the rotational accuracy of the same are sufficient to obtain a good accuracy only if the sufficient rigidity and the rotational accuracy of the grindstone can be obtained. As a result of this, the device can be obtained at a low cost.

What is claimed is:

1. A polishing device, comprising:

a grindstone rotatably supported on a frame, wherein the grinding surface of the grindstone faces upwardly, said grindstone being stationary with respect to upward and downward movement;

a supply means, disposed on said frame, for supplying a workpiece from an external source;

a delivery means, disposed on said frame, for delivering a workpiece already ground, from said polishing device to an external position;

a movable arm, supported on a support column mounted on said frame, said movable arm being movable in a generally horizontal manner in order to be sequentially positioned above said supply means, said delivery means, and said grindstone;

a pressurizing means, attached to said movable arm, for pressurizing a workpiece against the grindstone, said pressurizing means including, (a) a casing having a raising and lowering body disposed therein and being movable upwardly and downwardly within said casing, (b) a vertical shaft rotatably extending into said casing and being engaged with said raising and lowering body by way if a ball-threaded portion thereon, (c) a motor fixed to said movable arm for driving said vertical shaft, (d) a pair of coil springs, one positioned above said raising and lowering body, and the other positioned below said raising and lowering body, in order to be located between said raising and lowering body and said casing, such that said casing is substantially suspended from said vertical shaft, said springs and said raising and lowering body, such that in response to the rotation of said motor, said raising and lowering body moves upward or downward depending on the motor direction to provide upward force and movement or downward force and movement, respectively, to said casing by way of the elasticity of said springs;

an autorotating means attached to said casing and movable upward and downward with said casing, for imparting rotation to the workpiece; and a holding means attached to a rotating portion of said autorotating means for holding the workpiece beneath the autorotating means.

2. A polishing device according to claim 1, wherein said holding means includes a holding member provided at the lower end of said autorotating means, said holding member being provided to bring said workpiece into abutment against said grindstone by way of a ball joint.

* * * * *

UNITED STATES PATENT AND TRADEMARK OFFICE
CERTIFICATE OF CORRECTION

PATENT NO. : 4,837,979

DATED : June 13, 1989

INVENTOR(S) : Ishida et al

It is certified that error appears in the above-identified patent and that said Letters Patent is hereby corrected as shown below:

The title page showing the illustrative figure should be deleted to appear as per attached title page.

After sheet 2 of 2 of the drawings, insert figures 4 and 5 as shown on the attached page.

Signed and Sealed this

Twelfth Day of June, 1990

*Attest:*

HARRY F. MANBECK, JR.

*Attesting Officer*

*Commissioner of Patents and Trademarks*

United States Patent [19]

Ishida et al.

[11] Patent Number: 4,837,979

[45] Date of Patent: Jun. 13, 1989

[54] POLISHING DEVICE

[75] Inventors: Takao Ishida, Aichi; Hiroshi Hagiwara; Ichizo Kakumu, both of Nagoya, all of Japan

[73] Assignee: Sintobrator, Ltd., Nagoya, Japan

[21] Appl. No.: 168,819

[22] Filed: Mar. 16, 1988

[30] Foreign Application Priority Data

Mar. 17, 1987 [JP] Japan ..... 62-62109
Mar. 17, 1987 [JP] Japan ..... 62-62110
Mar. 27, 1987 [JP] Japan ..... 62-75638

[51] Int. Cl.[4] ..... B24B 7/16
[52] U.S. Cl. ..... 51/131.4; 51/215 CP
[58] Field of Search ..... 51/118, 123 R, 124 R, 51/124 L, 131.3, 131.4, 131.5, 132, 232, 234, 115, 215 R, 215 AR, 215 CP, 215 UL, 165.77, 165.8

[56] References Cited

U.S. PATENT DOCUMENTS 2,912,798 11/1959 Seidel ..... 51/215 UE
3,904,390 9/1975 Bottomby ..... 51/165.8
3,968,598 7/1976 Ogawa ..... 51/55
4,141,180 2/1979 Gill, Jr. ..... 51/124 R
4,680,893 7/1987 Cronkhite ..... 51/131.3

FOREIGN PATENT DOCUMENTS 0063625 4/1981 European Pat. Off. .
1222400 8/1966 Fed. Rep. of Germany .
2346431 3/1974 Fed. Rep. of Germany .
3339942 1/1985 Fed. Rep. of Germany .
236044 5/1986 Fed. Rep. of Germany .
1585540 1/1970 France .
0227361 12/1984 Japan ..... 51/131.3

OTHER PUBLICATIONS

Sovient Inventions Illustrated, Section Mechanical, Week 84/01 Abstract No. 004494 P61, 5th Feb., 1984, Derwent Publications, Ltd., London.

*Primary Examiner*—Frederick R. Schmidt
*Assistant Examiner*—Blynn Shideler
*Attorney, Agent, or Firm*—Armstrong, Nikaido, Marmelstein, Kubovcik & Murray

[57] ABSTRACT

The upper portion of a frame of a lapping device is provided with a device for supplying a workpiece, a grindstone, and a delivering device, and a movable arm is horizontally and movably supported by a support column of the frame in such a manner that the arm moves above the supplying device, grindstone, and the delivering device. The movable arm is provided with an device for autorotating the workpiece, the autorotating device being able to move upwardly or downwardly through the pressurizing device, and the movable arm further being provided with a device for holding the workpiece beneath the autorotating device. The workpiece is transported by the holding device to a position above the grindstone, and is brought into abutment with the grindstone by a holding member which is disposed at the lower end of the autorotating device, whereby it is ground with being rotated.

2 Claims, 3 Drawing Sheets

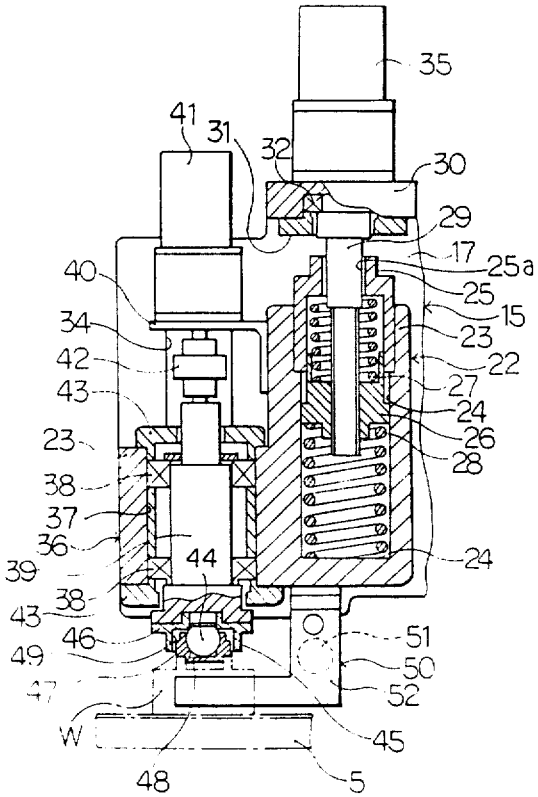

Patent No. 4,837,979